US008317575B2

(12) United States Patent
Carr

(10) Patent No.: US 8,317,575 B2
(45) Date of Patent: Nov. 27, 2012

(54) POWER TOILET BOWL CLEANING ATTACHMENT

(76) Inventor: Charles Neil Carr, Florence, AZ (US)

( * ) Notice: Subject to any disclaimer, the term of this patent is extended or adjusted under 35 U.S.C. 154(b) by 372 days.

(21) Appl. No.: 12/800,118

(22) Filed: May 10, 2010

(65) Prior Publication Data

US 2011/0271468 A1 Nov. 10, 2011

Related U.S. Application Data

(60) Provisional application No. 61/273,567, filed on Aug. 6, 2009.

(51) Int. Cl.
*B24B 27/08* (2006.01)

(52) U.S. Cl. ..... 451/358; 451/359; 451/352; 451/344; 451/444; 15/97.1

(58) Field of Classification Search ..... 451/358, 451/359, 357, 352, 344, 391, 415, 444, 915; 15/97.1

See application file for complete search history.

(56) References Cited

U.S. PATENT DOCUMENTS

| | | | | |
|---|---|---|---|---|
| 3,715,314 | A * | 2/1973 | Morgenstern | 510/368 |
| 5,052,840 | A * | 10/1991 | St. Cyer | 401/201 |
| 5,548,862 | A * | 8/1996 | Curtis | 15/118 |
| 5,899,796 | A * | 5/1999 | Kamiyama et al. | 451/61 |
| 5,970,559 | A * | 10/1999 | Christy | 15/106 |
| 6,196,898 | B1 * | 3/2001 | Naghi et al. | 451/28 |
| 6,596,395 | B1 * | 7/2003 | Muramatsu | 428/402 |
| 7,892,073 | B1 * | 2/2011 | Smania et al. | 451/50 |
| 2003/0207653 | A1 * | 11/2003 | Kapgan | 451/28 |
| 2005/0188491 | A1 * | 9/2005 | McLain | 15/230 |
| 2011/0271468 | A1 * | 11/2011 | Carr | 15/97.1 |
| 2012/0058715 | A1 * | 3/2012 | Roze | 451/50 |

* cited by examiner

*Primary Examiner* — Lee D Wilson
*Assistant Examiner* — Henry Hong

(57) ABSTRACT

An implement for cleaning mineral ring build up in a toilet bowl. The inventive device is an attachment driven by a cordless drill. It consists of a ball covered with a non abrasive material attached to a shaft which rotates the ball to remove mineral ring build up on toilet bowls.

8 Claims, 2 Drawing Sheets

POWER TOILET BOWL CLEANING ATTACHMENT

DESCRIPTION OF INVENTION

This application claims priority to Provisional Application 61/273,567, Date Aug. 6, 2009

Item to be patented referred hereafter as Power Toilet Cleaning Attachment, shall be made from the materials and assembled in the manner specified in technical drawing FIG. 1 and FIG. 2, can be easily manufactured and assembled with readily available materials. Power Toilet Bowl Cleaning Attachment is easily attached to the consumer's cordless drill. The rotary action produced by the drill enables the ball end to remove the built-up mineral deposits associated with hard water around the waterline of the toilet bowl.

1. A ball with pumice mixture adhered to ball.

2. Expanded fastener in ball.

3. Washer.

4. Nut to lock shaft solid to ball.

5. Plastic sleeve slipped over aluminum shaft for protection purposes.

6. Threaded aluminum shaft to drive ball.

Figure 2:
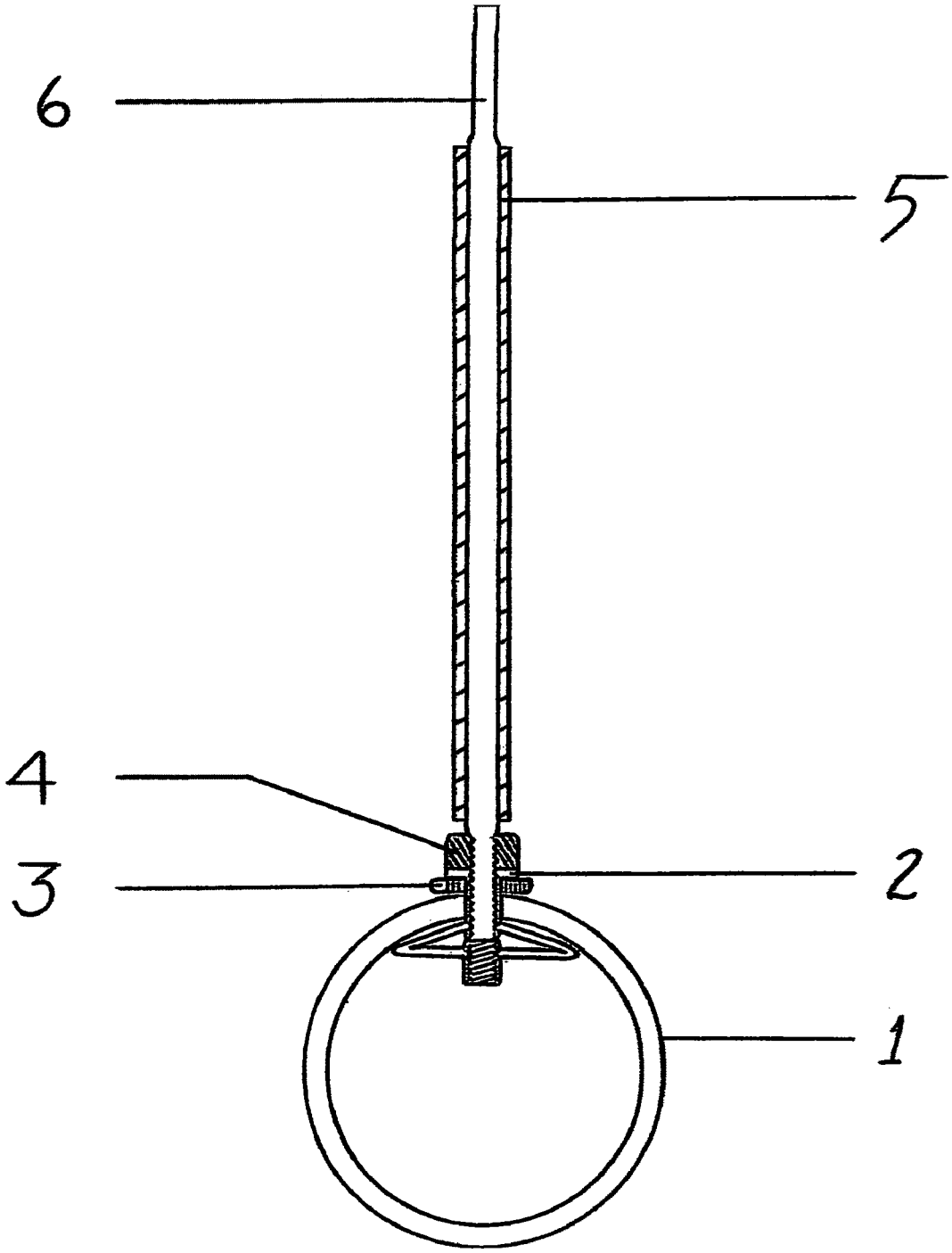

FIG. 2 Sectional drawing:

1. A ball with pumice mixture adhered to ball.

2. Expanded fastener in ball.

3. Washer.

4. Nut to lock shaft solid to ball.

5. Plastic sleeve slipped over aluminum shaft for protection purposes.

6. Threaded aluminum shaft to drive ball.

DETAILED DESCRIPTION

The present invention is described herein in detail in accord with the drawing and matching element numbers. The FIGS. 1 and 2 discloses an attachment tool having a shaft 6 with a proximal and distal end. The shaft 6 has a tapered end and a threaded end. The sphere or ball 1 is attached to the shaft 6 by a fastener or lock nut 4 with a washer 3 and toggle (expanded fastener) 2 having an expandable section with threaded ends. The sphere or ball 1 has an inner and outer surface with the toggle being inside of said sphere or ball. The nut is attached to the outside of said ball on the threaded end of the shaft 6. Furthermore the shaft has a sleeve and/or plastic sleeve 5. The Ball or sphere 1 has a waterproof adhesive attaching an abrasive and/or a pumice abrasive which is shown in FIG. 4. FIG. 4 shows an abrasive surface on the ball 1.

Figure 1:
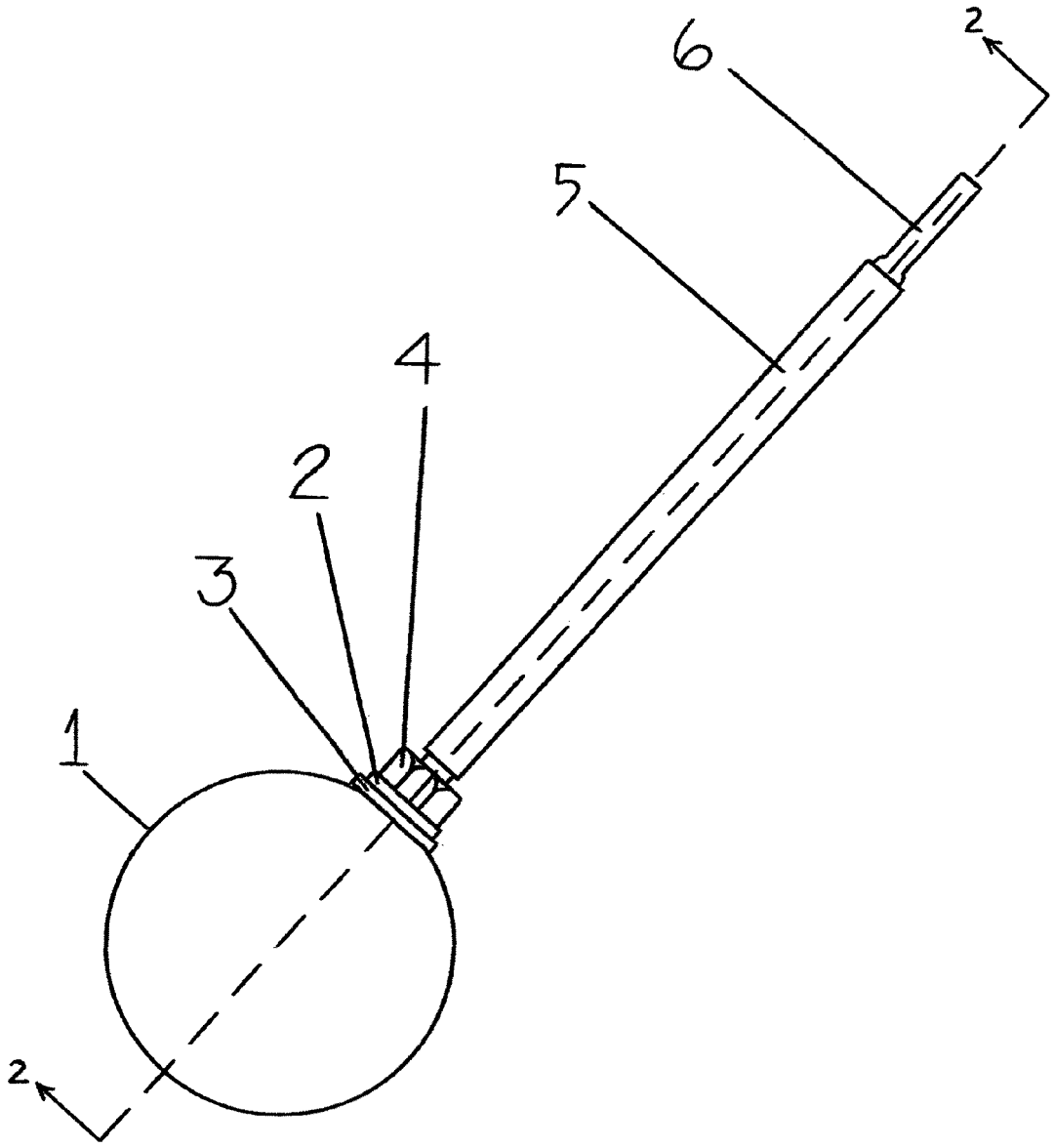
FIG. 1 Complete drawing.

FIG. 3 shows the combination of the device of FIGS. 1 and 2 being attachable with a power tool such as a drill. The power tool is not being invented but the use of the combination is being claimed because high speed are useful for removal of material in the toilet boil which is not shown. The attachment tool shown in FIGS. 1 and 2 are best used with a power tool but could conceivably be used by hand.

What is claimed is:

1. An apparatus for cleaning toilet bowls which removes minerals inside said toilet bowl and the apparatus further comprising:

a shaft comprising a tapered proximal end into an intermediate section and a distal threaded portion and;

a fastener which is placed on the distal end of said shaft and;

a sphere comprising an inner and outer surface with said outer surface with an abrasive and;

a toggle comprising an expanding section with threaded ends and;

wherein said shaft having said toggle connected within said sphere and said toggle attachable to said distal end of said shaft threaded end.

2. The apparatus according to claim 1 wherein said sphere further comprising a water proof adhesive which attaches said abrasive to said outer surface of said sphere.

3. The apparatus according to claim 2 wherein said abrasive further comprising a pumice material.

4. The apparatus according to claim 1 wherein said shaft comprising a sleeve.

5. A combination of an attachment and power tool for cleaning a toilet bowl which removes minerals inside said toilet bowl and the combination further comprising:

a power tool comprising a power source and chuck;

a shaft comprising a tapered proximal end into an intermediate section and a distal threaded portion and;

a fastener which is placed on the distal end of said shaft and;

a sphere comprising an inner and outer surface with said outer surface with an abrasive and;

a toggle comprising an expanding section with threaded ends and;

wherein said shaft being attachable with said chuck and said shaft having said toggle connected within said sphere and said toggle attachable to said distal end of said shaft threaded end.

6. The apparatus according to claim 5 wherein said sphere further comprising a water proof adhesive which attaches said abrasive to said outer surface of said sphere.

7. The apparatus according to claim 6 wherein said abrasive further comprising a pumice material.

8. The apparatus according to claim 5 wherein said shaft comprising a sleeve.

* * * * *